US010729959B2

(12) United States Patent
Linneman

(10) Patent No.: US 10,729,959 B2
(45) Date of Patent: Aug. 4, 2020

(54) ROTATIONAL STICK HANDLING TRAINING DEVICE

(71) Applicant: John Patrick Linneman, Nesconset, NY (US)

(72) Inventor: John Patrick Linneman, Nesconset, NY (US)

(73) Assignee: John Patrick Linneman, Nesconset, NY (US)

( * ) Notice: Subject to any disclaimer, the term of this patent is extended or adjusted under 35 U.S.C. 154(b) by 0 days.

(21) Appl. No.: 15/989,621

(22) Filed: May 25, 2018

(65) Prior Publication Data

US 2018/0339210 A1 Nov. 29, 2018

Related U.S. Application Data

(60) Provisional application No. 62/603,340, filed on May 26, 2017.

(51) Int. Cl.
*A63B 69/00* (2006.01)
*A63B 102/24* (2015.01)

(52) U.S. Cl.
CPC ..... *A63B 69/0026* (2013.01); *A63B 2102/24* (2015.10); *A63B 2225/09* (2013.01); *A63B 2225/093* (2013.01)

(58) Field of Classification Search
CPC ..... A63B 69/0026; A63B 2102/24
See application file for complete search history.

(56) References Cited

U.S. PATENT DOCUMENTS 2,818,255 A * 12/1957 Ponza ..... A63B 69/0091 473/146
3,794,320 A * 2/1974 Salmont ..... A63B 69/0024 473/429
4,158,458 A * 6/1979 Gomez ..... A63B 69/0079 473/575
5,226,821 A * 7/1993 Murphy ..... A63B 69/0026 434/247

(Continued)

OTHER PUBLICATIONS https://www.xhockeyproducts.com/xdangler.html; Jan. 13, 2018.*

(Continued)

*Primary Examiner* — Jeffrey S Vanderveen
(74) *Attorney, Agent, or Firm* — Grumbles Law PLLC; Brittany Nanzig; Stephen F. Wolf

(57) ABSTRACT

A rotational stick handling training device, which can be used by athletes, such as hockey players, to improve their stick handling skills. More specifically, a training device comprised of a central support system and one or more rotating projections on which a user can practice avoidance maneuvers. The central support system can include a mechanics housing, rotation mechanics located in the mechanics housing, and a central rod supported by the mechanics housing. Each of the rotating projections can include a shaft and a hockey blade located at a distal end of the shaft. The proximal end of each of the rotating projections can connect to a top portion of the central support system, such as the central rod, and the rotation mechanics can be structured and configured to rotate the central rod, causing the central rod to function as an axis about which the rotating projections can rotate.

17 Claims, 7 Drawing Sheets

(56) References Cited

U.S. PATENT DOCUMENTS

| | | | | |
|---|---|---|---|---|
| 5,795,251 | A * | 8/1998 | Andersen | A63B 69/0091 473/427 |
| 7,115,051 | B2 * | 10/2006 | Hansberry | A63B 69/0002 473/423 |
| 2016/0361616 | A1 * | 12/2016 | Downing | A63B 69/0075 |

OTHER PUBLICATIONS

Fan-tastic Sports, LLC; xDangler Pro Stickhandling System; Product listing; Jan. 13, 2018; 8 pp; https://www.xhockeyproducts.com/xdangler.html.

* cited by examiner

ROTATIONAL STICK HANDLING TRAINING DEVICE

CROSS-REFERENCE TO RELATED APPLICATION

This application claims the benefit of U.S. Provisional Application No. 62/603,340, filed May 26, 2017, which is titled Hockey stick handling practice machine.

BACKGROUND OF THE INVENTION

A main objective in the sport of hockey is to put the hockey puck into the opposing team's net. To accomplish this, players must maintain possession of the hockey puck by using a hockey stick to handle and pass the hockey puck between them. Therefore, a desired skill in the sport of hockey is the ability to hold onto and precisely pass the hockey puck. To improve this skill, teams hold practices where coaches run specific stick-handling drills for the players. Additionally, players often work on their own at home or on the ice to improve their stick-handling skills.

However, there are current limitations and disadvantages to available training tools. More specifically, most known products operate as static training tools that do not have the ability to imitate the movement of a competitor's defensive actions. The products that do incorporate movement are limited to back and forth, linear movement and are further limited to a small range of motion and movement from only a small portion of the bottom of the stick. Further, the products that do incorporate movement only offer a single stick as an obstacle and do not enable a user to rebound a hockey puck or ball off of the product.

Therefore, a new training tool is needed that more accurately simulates the actual movement of a competitor's defensive actions by having a larger portion of each stick as an obstacle, that is structured and configured to enable each stick to rotate through an entire 360-degree range of motion, and that provides a user with the ability to rebound a puck or ball off of the product.

SUMMARY OF THE INVENTION

The disclosed device is a rotational stick handling training device, which can be used by athletes, such as hockey players, to improve their stick handling skills. More specifically, in one embodiment, the training device is comprised of a central support system and one or more rotating projections on which a user can practice avoidance maneuvers. For example, the central support system can include a mechanics housing, rotation mechanics located in the mechanics housing, and a central rod supported by the mechanics housing. Each of the rotating projections can include a shaft having a proximal end and a distal end and a hockey blade located at the distal end of the shaft. The proximal end of each of the rotating projections can connect to a top portion of the central support system, such as the central rod, and the rotation mechanics can be structured and configured to rotate the central rod, causing the central rod to function as an axis about which the rotating projections can rotate.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
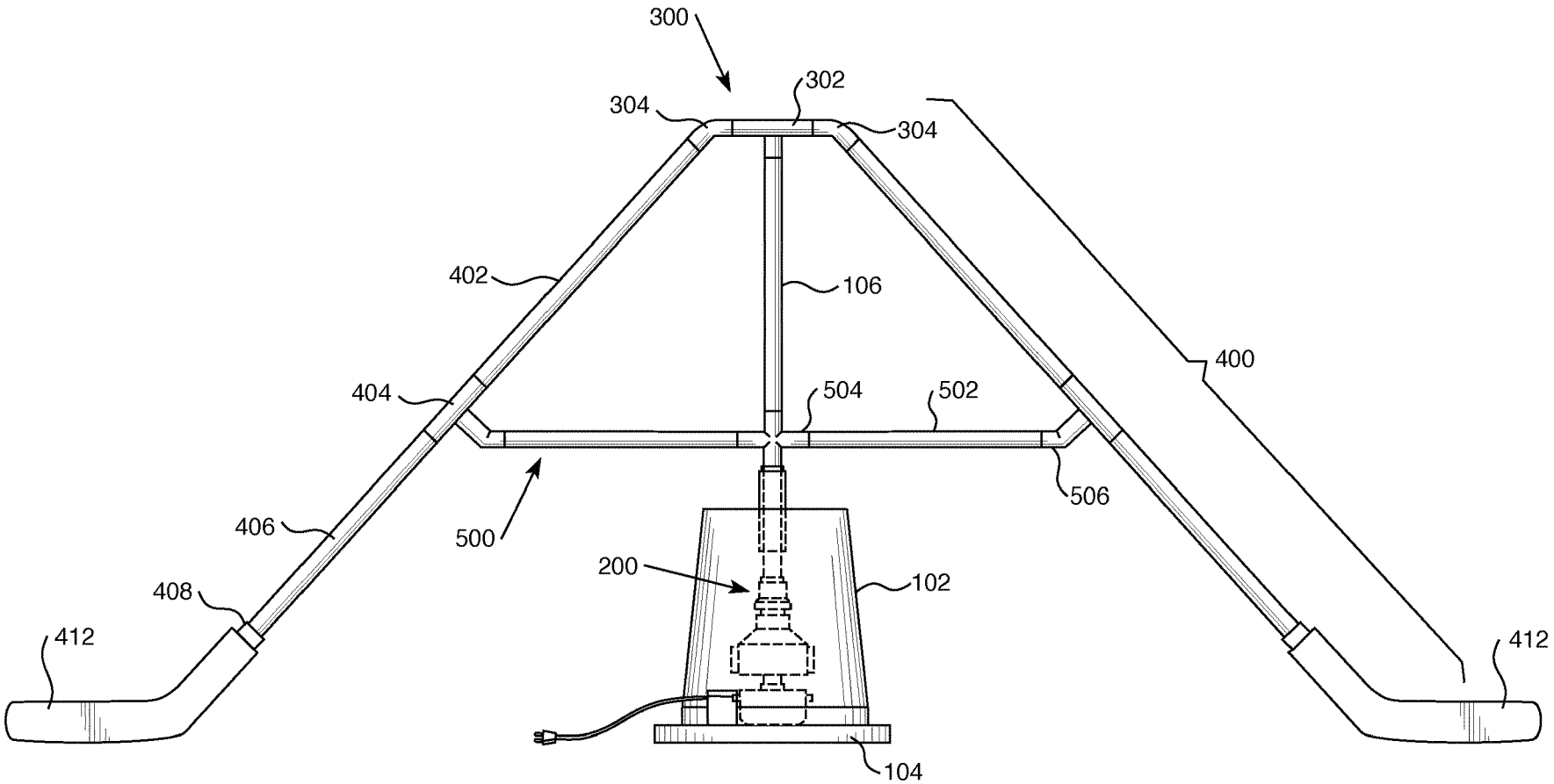
FIG. 1 is a front elevational view of one embodiment of the disclosed rotational stick handling training device and illustrates the rotation mechanics within the mechanics housing.

The present disclosure relates to training tools, and more particularly, relates to a rotational stick handling training device and system for athletes. Various embodiments are described in detail with reference to the drawings, wherein like reference numerals may be used to represent like parts and assemblies throughout the several views. Reference to various embodiments does not limit the scope of the claims attached hereto. Examples of construction, dimensions, and materials may be illustrated for the various elements, but those skilled in the art will recognize that many of the examples provided herein have suitable alternatives that may be utilized. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

The disclosed device is a rotational stick handling training device used by athletes, such as hockey players, to improve their stick handling skills. For example, one or more rotating projections can continuously spin around a central rod and can act as a barrier around which a user can practice avoidance maneuvers. More specifically, each of the rotating projections can be a hockey stick or stick-like projection having a hockey blade on its end and can represent an opposing player's hockey stick. Therefore, in use, an athlete can attempt to direct a hockey puck or training ball around the sides or over the top of the opposing rotating projection and, because the projections can continuously rotate in a 360-degree circle, the athlete can continue this maneuvering exercise indefinitely. While not specifically described herein, other training drills are envisioned that could assist an athlete in improving stick-handling skills.

Figure 2:
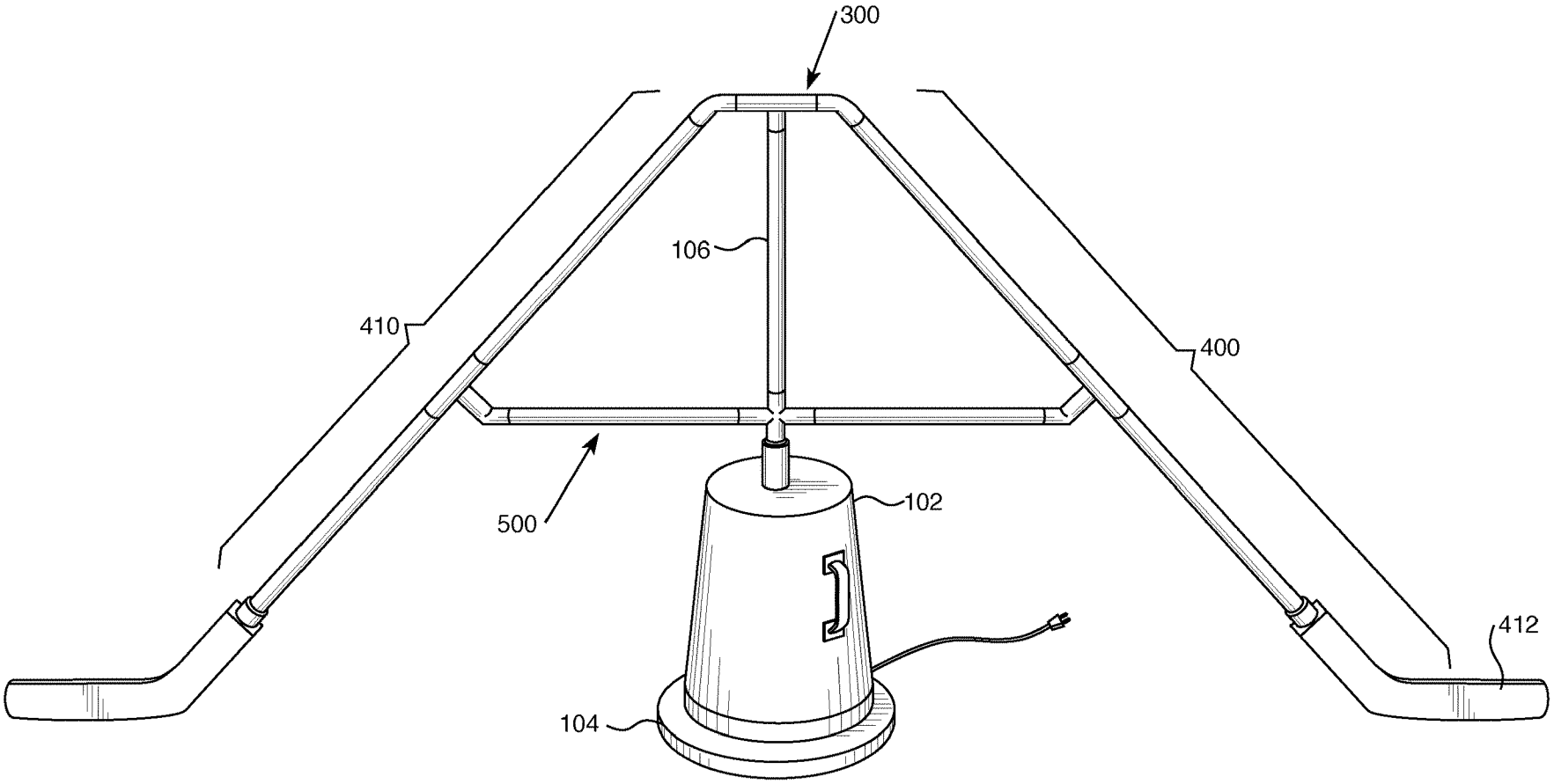
FIG. 2 is a front elevational view of the disclosed rotational stick handling training device.
Figure 3:
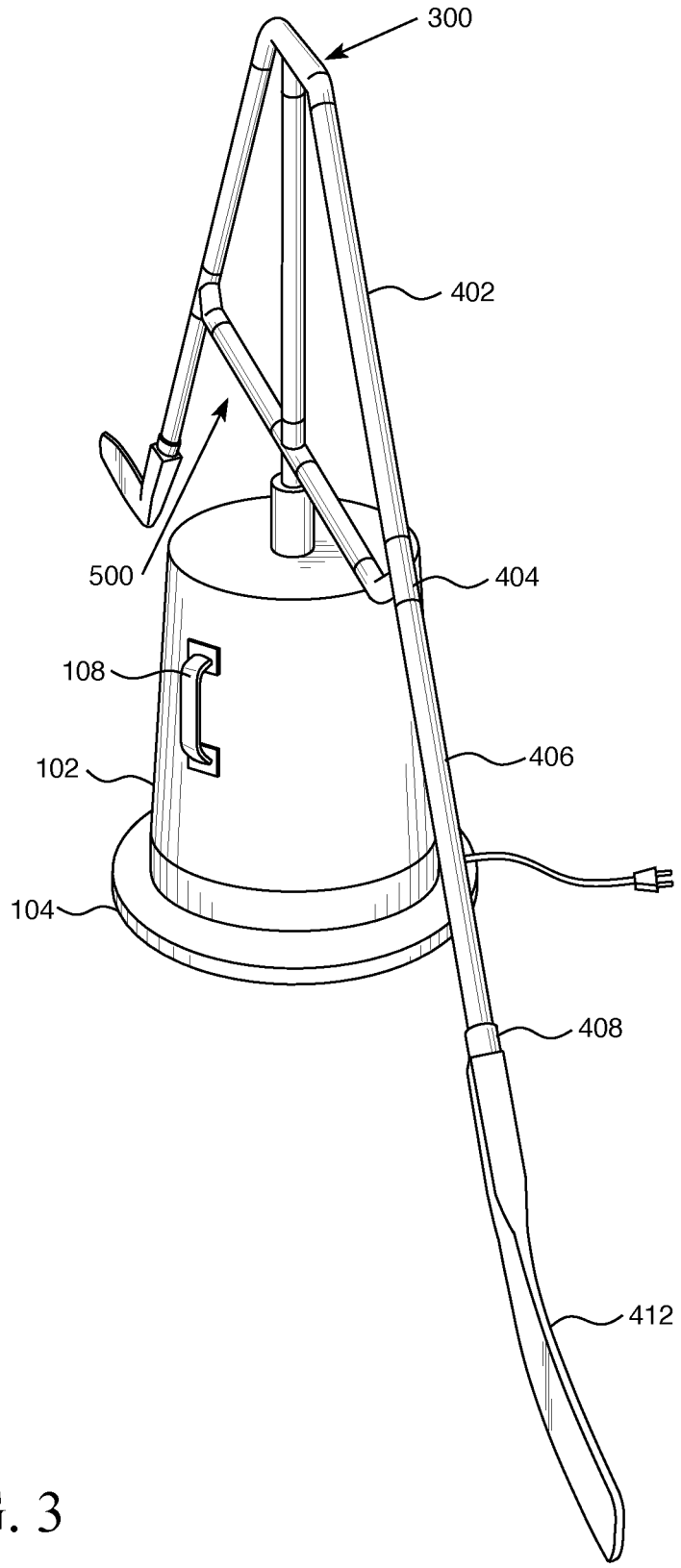
FIG. 3 is a side perspective view of the disclosed rotational stick handling training device having two rotating projections.

In some embodiments, the rotational stick handling training device includes a central support system 100 and one or more rotating projections 400 on which a user can practice avoidance maneuvers. For example, as illustrated in FIG. 1, central support system 100 can include mechanics housing 102 having base 104, central rod 106, cap 300, and rotation mechanics 200 within mechanics housing 102. Rotating projections 400, as illustrated in FIGS. 1-3, can include shaft 410 having a proximal end connected to cap 300 and a distal end connected to hockey blade 412. In some embodiments, the rotational stick handling training device further includes horizontal supports 500 that, as illustrated in FIGS. 1-2 and 4-5, can each include support rod 502 having a proximal end connected to central rod 106 and a distal end connected to shaft 410.

Central Support System

As mentioned above, central support system 100 can be primarily comprised of mechanics housing 102 having base 104, central rod 106, cap 300, and rotation mechanics 200. Mechanics housing 102 can be structured and configured to contain and protect rotation mechanics 200. Therefore, it can be at least partially hollow and its dimensions and shape can be, at least in part, determined by the dimension and shape of rotation mechanics 200. For example, as illustrated in FIG. 1, rotation mechanics 200 are relatively taller than they are wide and, therefore, mechanics housing 102 can be roughly cylindrical in shape. However, mechanics housing 102 could also be a rectangular box, a cone (with or without a flat top), a cube, or any other three-dimensional shape.

Mechanics housing 102 can also have base 104. Base 104 can function to contain rotation mechanics 200 within mechanics housing 102 when the device is lifted (for example, for transportation or placement in a different training area). For example, rotation mechanics 200 and/or mechanics housing 102 can be mounted to a top face of base 104. In some embodiments, as illustrated in FIGS. 1-7, the top face of base 104 has a larger surface area than a bottom face of mechanics housing 102, thereby ensuring the base covers the entire bottom face of the housing. However, this is not necessary and base 104 may be structured to have a similar shape and size as the bottom face of mechanics housing 102.

In some embodiments, mechanics housing 102, base 104, or both can be constructed from a rubber or rubber-like material. This enables a user to bounce or rebound a hockey puck or ball off of the surface of mechanics housing 102 and/or base 104 while practicing avoidance maneuvers. In other embodiments, a bumper can be positioned and attached to base 104. For example, spokes can attach to the outer surface of base 104 and an inner surface of a ring. The ring can be flexible to enable a user to bounce or rebound a hockey puck/ball off of it. This enables base 104 to be rigid and provide additional impact-based and liquid-based protection to rotation mechanics 200. While a circle is one intuitive example of the ring's shape, the ring is not limited to a circular configuration and can take on other shapes such as, but not limited to, a rectangle, square, triangle, or other polygon.

In addition to housing 102 and base 104, central support system 100 can include central rod 106. Central rod 106 can be a vertical pipe or pole and can have a bottom, a main body, and a top. The bottom of central rod 106 can attach to rotation mechanics 200 within mechanics housing 102 (for example, to rod support architecture 206 described below) and the top of central rod can attach to cap 300 or directly to rotating projections 400. The main body of central rod 106 can act as a mount to which other pieces and components of the rotational stick handling training device can attach such as, but not limited to, horizontal supports 500. In some embodiments, central rod 106 can be hollow or have hollow portions. In other embodiments, central rod 106 can be solid.

Figure 7:
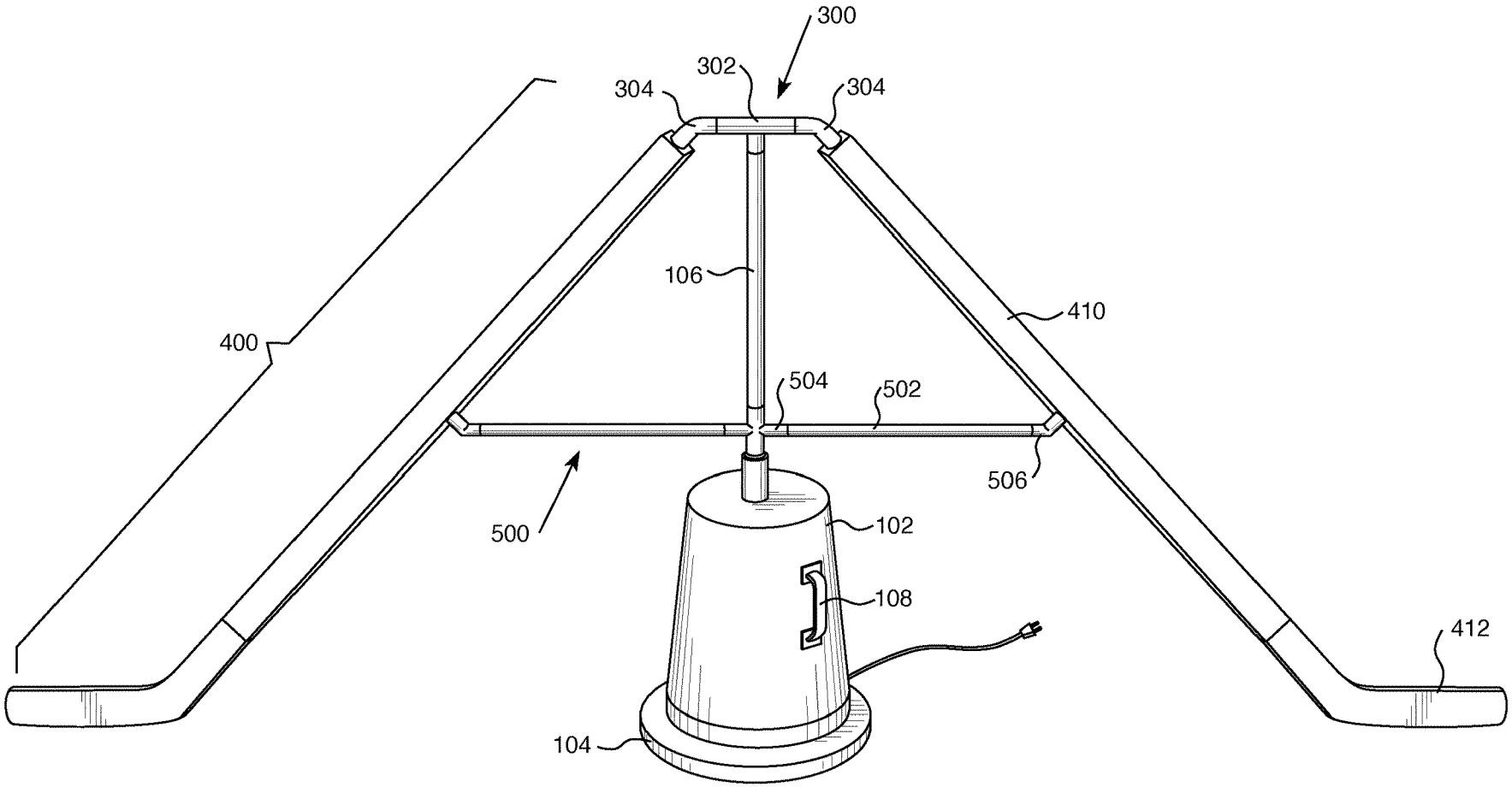
FIG. 7 is a front elevational view of the disclosed rotational stick handling training device, wherein the rotating projections are hockey sticks.

As mentioned above, central support system 100 can also include cap 300. More specifically, cap 300 can include central rod cap 302 that connects directly to the top of central rod 106 and one or more shaft connector caps 304 connected on a first of each of their ends to central rod cap, as illustrated in FIGS. 1-5 and 7. A second end of each shaft connector cap 304 can connect to a corresponding rotating projection 400. For example, if rotating projection 400 is a hockey stick, as illustrated in FIG. 7, each shaft connector cap 304 can be a clamp that clamps onto shaft 410. In another example, if rotating projection 400 is comprised of independent parts that mimic a hockey stick (for example, pipes and connectors), as illustrated in FIG. 2, each shaft connector cap 304 may be a fitting such as, but not limited to, a pipe fitting, into which a top of shaft 410 can fit.

Figure 4:
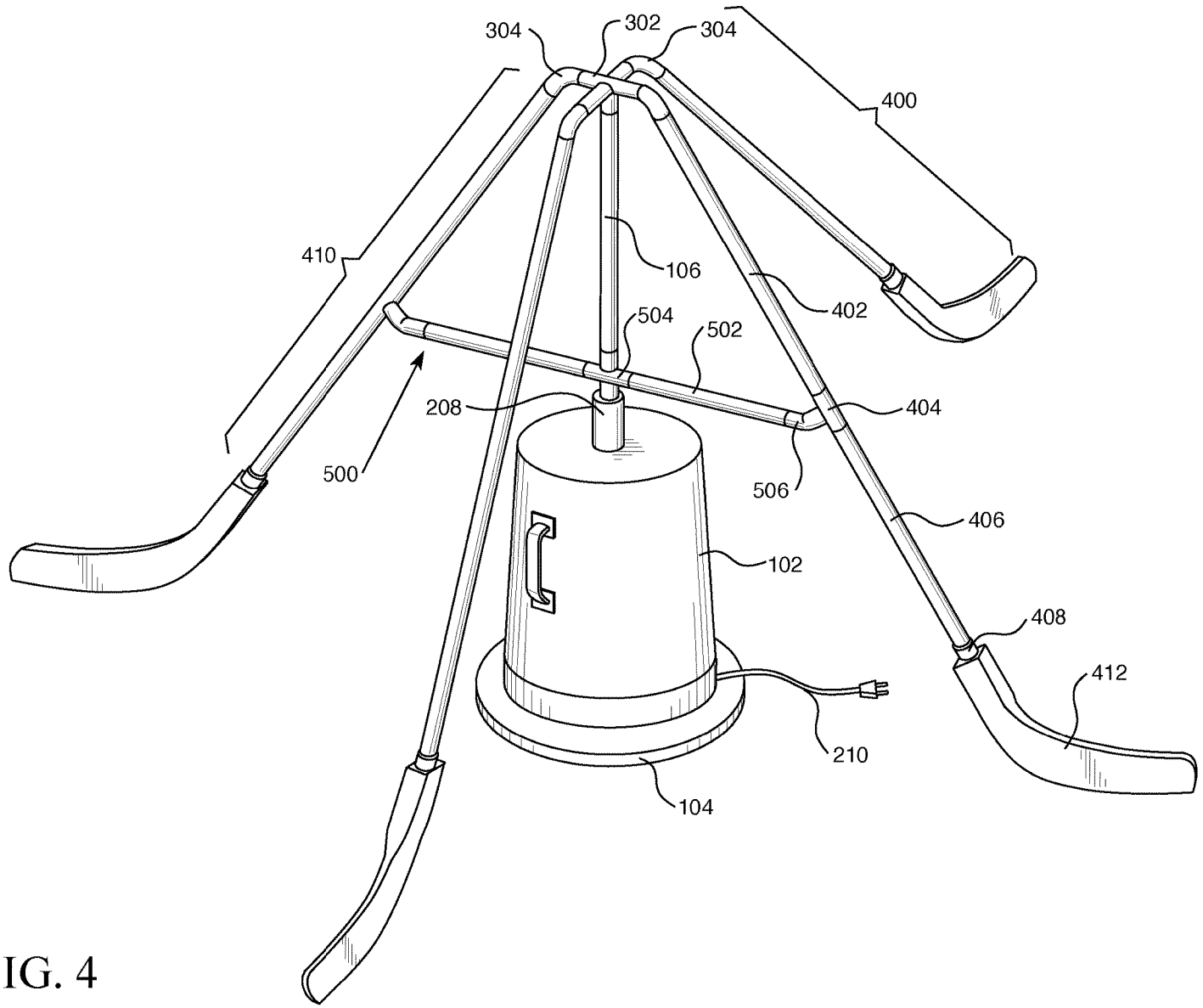
FIG. 4 is a side perspective view of the disclosed rotational stick handling training device having four rotating projections.
Figure 5:
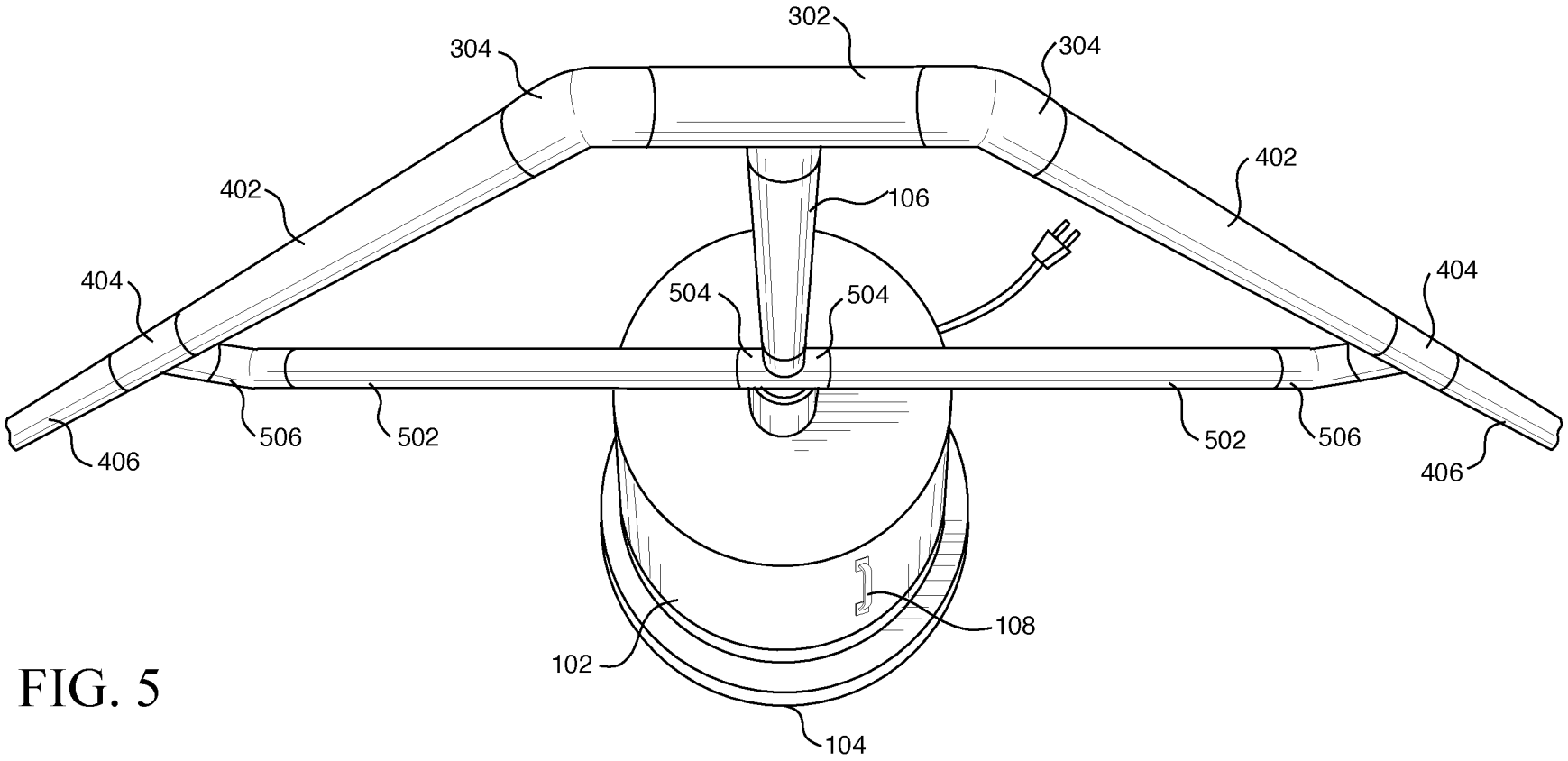
FIG. 5 is a top perspective view of the disclosed rotational stick handling training device.

While cap 300 is illustrated as having two shaft connector caps 304, as illustrated in FIGS. 1-3, 5, and 7, or four shaft connector caps, as illustrated in FIG. 4, cap can have any number of shaft connector caps and is not limited to those shown in the figures. For example, in some embodiments, cap 300 may have one shaft connector cap 304. Further, in some embodiments, rotating projections 400 may be removable, and a user can determine how many rotating projections to attach to the device. For example, the device may include four shaft connector caps 304 but only have two rotating projections 400 attached, leaving two shaft connector caps 304 attached on their first ends to central rod cap 302 and unattached on their second ends.

Figure 6:
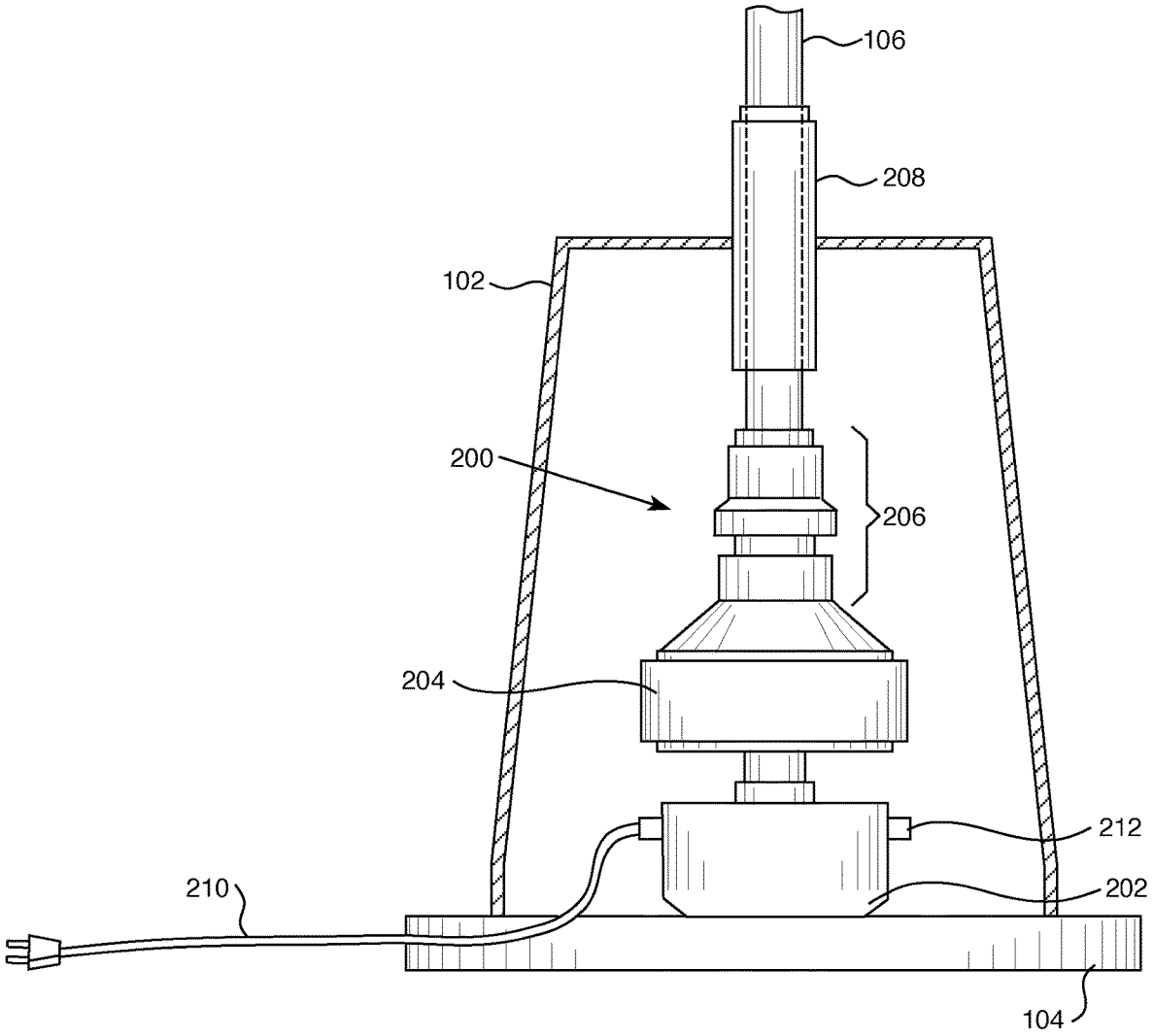
FIG. 6 is a front view of the rotation mechanics of the disclosed rotational stick handling training device.

As described above, the bottom of central rod 106 can connect to the device within mechanics housing 102. In some embodiments, central rod 106 connects to rotation mechanics 200. Rotation mechanics 200 can dictate the speed and direction that central rod 106 spins. They can be electrical in nature and can include, but are not limited to, switch housing 202, motor 204, rod support architecture 206, coupling 208, and a power source (for example, power cord 210). As illustrated in FIG. 6, switch housing 202, motor 204, rod support architecture 206, and portions of coupling 208 can be housed within mechanics housing 102.

In some embodiments, switch housing 202 can include control switch 212 and can connect to a power source and to motor 204. Switch housing 202 can be structured and configured to draw power from the power source and to pass it to motor 204, which can connect directly or indirectly to central rod 106. The power source can be any type of power source such as, but not limited to, power cord 210, a storage cell (for example, batteries or other electrochemical cells), or any other type of electrical power source.

Switch housing 202 can also determine the speed and direction that motor 204 spins. For example, switch housing 202 can draw a larger current from the power source to increase motor speed and can switch polarity to change motor direction. More specifically, a user can activate control switch 212 to change polarity of switch housing 202 and, therefore, change direction of spin for central rod 106. Because of the connection that motor 204 has to central rod 106, as motor changes speed and direction, so does central rod 106.

In some embodiments, switch housing 202 can be remotely controlled. Therefore, a user can change the speed and direction of central rod 106 and, therefore, rotating projections 400 without first turning off or deactivating the device. One example where this would be useful is when a coach wishes to incorporate interval training for an athlete. More specifically, a coach could increase and decrease the speed at which rotating projections 400 spin by controlling switch housing 202, which would alter the rate at which an athlete comes into contact with rotating projections and which would force the athlete to stay continuously alert. In another example, the coach or other user could alternate the polarity of switch housing 202 to cause rotating projections 400 to rotate back and forth as opposed to continuously in a 360-degree circle. This would also encourage an athlete to stay continuously alert of where rotating projections 400 are located and when they might come into contact with the athlete.

In other embodiments, instead of being electrical in nature, rotation mechanics 200 can be mechanical in nature. For example, rotation mechanics 200 can have a wind-up mechanism, wherein the wind-up mechanism can be a clockwork motor having gears, and it can be spring powered. A user can use a crank attached to the gears to store energy in the mechanism and, once the user stops turning the crank, the gears can then cause central rod 106 to turn in a clockwise or counterclockwise rotation.

In another example, rotation mechanics 200 can use a simpler rubber band version of a wind-up mechanism, wherein a rubber band or group of rubber bands connects on one end to the rotating projections 400 and on another end to rotation mechanics 200. Therefore, when rotating projections 400 are pushed in a clockwise or counterclockwise direction, the rubber bands(s) are pulled and they twist around central rod 106 or another component and energy is stored in the rubber band(s). When rotating projections 400 are released, the rubber band(s) pulls itself back into an untwisted configuration, which causes central rod 106 to spin rotating projections in the opposite direction as they were wound up.

If rotation mechanics 200 are mechanical in nature, they can include, but are not limited to, energy storage (for example, gears/springs or rubber band(s)), rod support architecture 206, and coupling 208. Therefore, the energy storage could connect, directly or indirectly, to central rod 106. Further, rod support architecture 206 could support central rod 106, and coupling 208 could assist central rod as it transitions from an interior of mechanics housing 102 to an exterior of mechanics housing.

In another embodiment, the rotational stick handling training device may not include rotation mechanics 200. For example, rotating projections 400 can be, in some embodiments, manually pushed by a second user to allow the first user to practice avoidance maneuvers on rotating projections. For example, the second user can directly push rotating projections 400. In another example, the device can include a turning mechanism attached near a top of central rod 106 that has an outward projection. This can enable the second user to stand at a distance far enough away from rotating projections 400 to prevent impact with them, but to continuously provide spin to central rod 106. For example, a series of gears and/or pulleys can be structured and configured to allow the second user to provide torque to central rod 106 at a distance.

As mentioned above, in addition to switch housing 202 and motor 204, rotation mechanics 200 can include rod support architecture 206. In some embodiments, rod support architecture 206, in combination with switch housing 202 and/or motor 204, may be located inside of mechanics housing 102. Therefore, rod support architecture 206 can take any exterior structural shape, although it may be limited in size and/or shape by the interior dimensions of mechanics housing 102 as well as any space taken up by switch housing 202, motor 204, coupling 206 and/or any other rotation mechanics 200 located within mechanics housing. The internal portion of rod support architecture 206 can be structured and configured to support central rod 106 and to ensure central rod can freely rotate and remain in a vertical orientation, especially while in use.

In some embodiments, rod support architecture 206 can connect directly to motor 204, as illustrated in FIG. 6. In other embodiments, for example if there is no switch housing 202 and/or motor 204, rod support architecture 206 can attach directly to mechanics housing 102 (for example, to base 104). Therefore, the bottom of central rod 106 can attach directly to rod support architecture 206, to motor 204, or to any portion of mechanics housing 102, such as base 104. Further, rod support architecture 206 can support a lower portion of central rod 106, thereby enabling it to maintain a vertical orientation.

In some embodiments, as described above, coupling 208 can also stabilize central rod 106 and enable it to transition from an interior of mechanics housing 102 to an exterior of mechanics housing where it can connect to cap 300 and, therefore, rotating projections 400. Coupling 208 can have a roughly cylindrical exterior, as illustrated in FIGS. 3-4 and 6, although the exterior shape can also be rectangular or can have any other polygonal shape. Additionally, coupling 208 can be hollow and can have a roughly cylindrical interior. Therefore, coupling 208 can work with rod support architecture 206 to keep central rod 106 centered in mechanics housing 102 while central rod rotates.

More specifically, coupling 208 can be structured and configured to have a vertical orientation positioned directly above, and in line with, rod support architecture 206. Therefore, central rod 106 can be positioned within, and supported by, both rod support architecture 206 and coupling 208 while retaining its ability to freely rotate. However, whereas rod support architecture 206 may be located inside mechanics housing 102, coupling 208 can transition through a top portion of mechanics housing so separate portions of coupling are inside of or exterior to mechanics housing. More specifically, coupling 208 can have a central portion of its exterior surface attached to a central portion of a top of mechanics housing 102, as illustrated in FIGS. 2-5 and 7, so that a lower portion of coupling is in an interior of mechanics housing and an upper portion of coupling is exterior to mechanics housing.

Rotating Projections

As mentioned above, rotating projections 400 can be primarily comprised of shaft 410 and hockey blade 412, wherein a proximal end of shaft is connected to cap 300 or, alternatively, to central rod 106, and a distal end is connected to hockey blade. Rotating projections 400 can function as obstacles on which a user can practice avoidance maneuvers with the user's own hockey stick and puck or ball. More specifically, as central rod 106 rotates in a clockwise or counterclockwise direction, it acts as an axis about which rotating projections 400 can also rotate in a corresponding clockwise or counterclockwise direction. In some embodiments, rotating projections 400 can be hockey sticks and, therefore, shaft 410 can be the shaft of a hockey stick and can include a hockey blade 412 at a distal end, as illustrated in FIG. 7. In other embodiments, rotating projections 400 can be comprised of several component parts, as illustrated in FIG. 1.

More specifically, as illustrated in FIGS. 1-5, rotating projections 400 can each be comprised of shaft 410 and blade 412. Shaft 410 can further be comprised of upper shaft 402, shaft support 404, lower shaft 406, and blade connector 408, wherein blade connector is structured and configured to connect to blade 412. Upper shaft 402 and lower shaft 406 can both be pipes or poles and can be cylindrical or any other elongated shape.

As mentioned above, a proximal end of shaft can connect to cap 300 and a distal end can connect to hockey blade 412. More specifically, a top of upper shaft 402 can connect to shaft connector cap 304 and a bottom of lower shaft 406 can connect directly to blade 412 or to blade connector 408, which in turn connects to blade. Alternatively, upper shaft 402 and lower shaft 406 may be one piece, and a top of the single shaft can connect to shaft connector cap 304 while a bottom of the single shaft can connect directly to blade 412 or to blade connector 408, which in turn connects to blade.

In addition to attaching to cap 300 and blade 412, upper shaft 402 and lower shaft 406 can each connect to shaft support 404. More specifically, shaft support 404 can be a fitting, such as a pipe fitting, that can strengthen shaft 410, which can ensure it does not break if it comes into contact with user, user's hockey stick, or a hockey puck/ball. In some embodiments, shaft support 404 may be flexible and may allow lower shaft 406 to move backwards and forwards at a non-linear angle to upper shaft 402.

In other embodiments, shaft support 404 may be a lever or other type of lock. More specifically, lower shaft 406 may telescope into and out of upper shaft 402, and shaft support 404 may be structured and configured to lock lower shaft at a specific length. In other embodiments, upper shaft 402 may telescope into lower shaft 406 using the same locking mechanism. In a further embodiment, both upper shaft 402 and lower shaft 406 can be telescoping. For example, each shaft 402, 406 can be comprised of multiple shaft parts, which can telescope into, and out of, each other.

By having telescoping capabilities, shaft 410 can vary its length and its angle to central rod 106. For example, shaft 410 can transition from having a roughly 45-degree angle to central rod 106 to having a 30-degree angle to central rod. Additionally, as shaft 410 shortens its length, it can move closer to central support system 100 to maintain contact with the ground. When shaft 410 is closer to central support system 100, the rate at which a user comes into contact with rotating projection 400 increases.

Therefore, as an alternative to increasing the speed at which center rod 106 spins, a user can shorten the length of shaft 410. In this case, shaft connector cap 304 can be flexible, which can allow rotating projection to increase or decrease its angle relative to center rod 106. For example, if shaft 410 is shortened and rotating projection 400 is moved closer to central support system 100, the angle between shaft and center rod 106 decreases. If shaft 410 is lengthened and rotating projection 400 is moved further away from central support system 100, the angle between shaft and center rod 106 increases.

In some cases, instead of moving shaft 410 closer to central rod 106 as shaft shortens, a user may keep shaft at its current angle and allow blade 412 to hover off the ground leaving air between the bottom of blade and the ground. This can enable user to practice moving the hockey puck/ball underneath blade 412 in addition to over and around it. In other cases, a user can both move shaft 410 closer to central rod 106 and keep blade 412 off the ground by shortening shaft more than the corresponding angle would require to keep blade on the ground.

In some embodiments, the top of each upper shaft 402 may have a notch or specific shape or cutout to ensure upper shaft attaches to shaft connector cap 304 in the correct orientation. Similarly, the bottom of lower shaft 406 may have a notch or specific shape or cutout to ensure lower shaft attaches to blade connector 408 in the correct orientation. Further, the bottom of each upper shaft 402 and the top of each lower shaft 406 may also include a notice or specific shape or cutout to ensure shafts, 402, 406 attach to shaft support 404 in the correct orientation.

As with shaft support 404, blade connector 408 can be a fitting, such as a pipe fitting, that can strengthen the connection between shaft 410 and hockey blade 412, which can ensure rotating projection 400 does not break if it comes into contact with user, user's hockey stick, or a hockey puck/ball. In some embodiments, blade connector 408 may be flexible and may allow blade 412 to move backwards and forwards at an angle to shaft 410.

In other embodiments, blade connector 408 may be a lock or lever that enables blade 412 to be removable. This would enable a user to switch out blades or to attach other types of obstacles on the end of shaft 410. For example, user could attach a larger blade or other shaped obstacle to make it more difficult to maneuver around the obstacle. For example, user could remove blade 412 and replace it with a T-shaped object that, when attached, would shorten the available space between its center-most end and central support system 100, which would make it more difficult for user to avoid contact with the device. More specifically, whereas blade 412 has a relatively flat-face and L shape with its short portion connecting to blade connector 408 or shaft 410 directly and its longer portion projecting away from central support system 100, the elongated portion of a T-shaped object could project both away and toward central support system.

Alternatively, a user could attach a target that the user can aim to hit with the hockey puck/ball, or the user can attach an object having a gap or hole into which the user can aim to get the hockey puck/ball. For example, an attachment that could replace blade 412 could be a roughly flat, circular object having a hole in its center. When the rotating projection approaches the user, the flat face of the circular object could face the user, and the user could aim to send the hockey puck/ball through the center hole.

Horizontal Supports

As mentioned above, the rotational stick handling training device can further include horizontal supports 500 that, as illustrated in FIGS. 1-2 and 4-5, can each include support rod 502 having a proximal end connected to central rod 106 and a distal end connected to shaft 410. Horizontal supports 500 can function to strengthen and support rotating projections 400 and, therefore, each rotating projection can be attached to a corresponding horizontal support. In some embodiments, horizontal supports 500 can be comprised of support rod 502, horizontal shaft connector 504, and horizontal rod connector 506, as illustrated in FIG. 1.

As with upper shaft 402 and lower shaft 406, support rod 502 can be a pipe or pole and can be cylindrical or any other shape. Support rod 502, as illustrated in FIG. 1, can extend perpendicularly to central rod 106 and at a non-right angle to rotating projection 400. Additionally, support rod 502 can have telescoping capabilities to enable shaft to move closer to central support system 100. This may be important, for example, if shaft 410 has telescoping capabilities and a user wishes to move rotating projection 400 closer to central rod 106.

For example, support rod 502 can be comprised of multiple telescoping parts that telescope into and out of each other. In another example, a first support rod may telescope into a second support rod on an opposing side of central support system 100. Therefore, opposing support rods could have differing diameters to ensure one can telescope into the other. Additionally, the larger support rod could move through horizontal rod connector 506 and over the smaller support rod. By allowing bi-directional movement of support rods 502, both rotating projections 400 could be at the same distance from central support system 100. Further, to support this form of telescoping, central rod 106 could be comprised of multiple pieces (for example, one above and one below horizontal rod connector 506), and horizontal rod connector 506 could have fittings to ensure that all component parts are held in place relative to each other.

In some embodiments, support rod 502 may be stretchable or may have stretchable components. As central rod 106 spins and centrifugal force is placed on rotating projections 400, rotating projections can extend further from central rod, while remaining attached to central rod. Therefore, the speed at which central rod 106 rotates may impact how far or how close rotating projections 400 remain to central rod during use.

Similar to shaft support 404 and blade connector 408, horizontal shaft connector 504 and horizontal rod connector 506 can be fittings, such as pipe fittings. Alternatively, connectors 504, 506 can be flexible to enable movement of support rod 502 at a horizontal angle. In some embodiments, horizontal shaft connector 504 can connect horizontal support rod 502 to shaft 410 and, more specifically, to shaft support 404. Alternatively, horizontal shaft connector 504 can connect horizontal support rod 502 to either upper shaft 402 or lower shaft 404.

In some embodiments, horizontal shaft connector 504 and/or horizontal rod connector 506 may be levers or locks. For example, if rotating projections 400 are hockey sticks, horizontal shaft connector 504 can be clamps or clasps that grab onto the shaft of each hockey stick. Connectors 504, 506 that act as levers or locks can also enable break down of the device for transportation. More specifically, a user can unlock these connectors 504 and/or 506 to enable removal of support rod 502. It can also enable telescoping of support rod 502. For example, a user could unlock horizontal rod connectors 506 to enable a first support rod to telescope into a second support rod on an opposing side of central rod 106.

In some cases, the entire device is collapsible to enable a user to transport the device more easily. For example, horizontal rod connector 506 may removably connect to central rod 106 and support rod 502. Further, central rod cap 302, central rod 106, shaft connector cap 304, and shaft 410 may all be removably connected to each other. If shaft 410 is comprised of component pieces, its pieces (for example, upper shaft 402, shaft support 404, lower shaft 406, blade connector 408, and blade 412) may also all be removably connected to each other.

Persons of ordinary skill in arts relevant to this disclosure and subject matter hereof will recognize that embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments. Moreover, elements described with respect to one embodiment can be implemented in other embodiments even when not described in such embodiments, unless otherwise noted.

For purposes of interpreting the claims, it is expressly intended that the provisions of 35 U.S.C. 112(f) are not to be invoked unless the specific terms "means for" or "step for" are recited in a claim.

What is claimed is:

1. A rotational stick handling training device comprising:

a central support system comprising:

a mechanics housing, rotation mechanics within the mechanics housing; and a central rod supported by the mechanics housing; and one or more rotating projections on which a user practices avoidance maneuvers, each of the one or more rotating projections comprising:

a shaft having a proximal end and a distal end and comprising an upper shaft, a lower shaft, and a shaft support with the shaft support disposed between the upper shaft and the lower shaft;

at least one horizontal support rod having a proximal end connected to the central rod and a distal end connected to the shaft support; and a hockey blade located at the distal end of the shaft;

wherein:

the shaft support is structured and configured to strengthen the shaft ensuring that it does not break if it comes into contact with a user, a user's stick, or a hockey puck/ball;

the proximal end of the shaft for each of the one or more rotating projections connects to a top portion of the central support system; and the rotation mechanics are structured and configured to rotate the central rod, causing the central rod to function as an axis about which the one or more rotating projections rotate.

2. The rotational stick handling training device of claim 1, wherein the rotation mechanics are mechanically powered.

3. The rotational stick handling training device of claim 1, wherein the rotation mechanics are electrically powered.

4. The rotational stick handling training device of claim 1, wherein a portion of the mechanics housing is structured and configured to repel a hockey puck.

5. The rotational stick handling training device of claim 1, wherein the rotating projections are removable from the central support system.

6. The rotational stick handling training device of claim 5, wherein the one or more rotating projections are hockey sticks having a shaft and a blade.

7. The rotational stick handling training device of claim 1, further comprising one or more horizontal support rods that are structured and configured to attach to a main body of the central rod and to a corresponding shaft.

8. The rotational stick handling training device of claim 7, wherein the shaft, the one or more horizontal support rods, or both are structured and configured to telescope and alter their corresponding lengths.

9. The rotational stick handling training device of claim 1, wherein the rotation mechanics determine a rotational speed and a direction of spin for the central rod.

10. The rotational stick handling training device of claim 9, wherein the rotational speed, the direction of spin, or both are consistent.

11. The rotational stick handling training device of claim 9, wherein the rotational speed, the direction of spin, or both are variable.

12. The rotational stick handling training device of claim 1, wherein the top portion of the central support system is comprised of a cap having:

a central rod cap attached to a top of the central rod; and one or more shaft connector caps, each connected to the central rod cap.

13. The rotational stick handling training device of claim 12, wherein the proximal end of the shaft for each of the one or more rotating projections connects to a corresponding shaft connector cap.

14. The rotational stick handling training device of claim 1, wherein the one or more rotating projections continuously rotate in a 360-degree circle.

15. A rotational stick handling training device comprising:

a central support system comprising:

a mechanics housing having a base, rotation mechanics within the mechanics housing that are comprised of:

a power source, a motor, a switch housing connected to the power source and the motor, rod support architecture connected to the motor, and a coupling having an open top and bottom and a portion of an exterior surface attached to a central portion of a top of the mechanics housing, and a central rod having a bottom, a main body, and a top, wherein the bottom of the central rod is attached to the rod support architecture, the coupling surrounds a portion of the central rod and is structured and configured to transition the central rod from an interior of the mechanics housing to an exterior of the mechanics housing, and the rotation mechanics are structured and configured to rotate the central rod, causing the central rod to function as a rotational axis, and a cap comprised of:

a central rod cap attached to the top of the central rod, and one or more shaft connector caps, each connected to the central rod cap;

one or more rotating projections that rotate about the central rod, each of the one or more rotating projections comprising:

a shaft comprised of an upper shaft, a lower shaft, and a shaft support disposed between the upper shaft and the lower shaft, the shaft having a proximal end and a distal end, wherein the proximal end is connected to a corresponding shaft connector cap;

at least one horizontal support rod having a proximal end connected to the central rod and a distal end connected to the shaft support, and a hockey blade located at the distal end of the shaft; and one or more horizontal supports, each horizontal support comprising:

a support rod having a proximal end and a distal end, a horizontal rod connector, and a horizontal shaft connector, wherein:

the proximal end of each support rod connects to the horizontal rod connector, which is located on the main body of the central rod; and the distal end of each support rod connects to the horizontal shaft connector, which is positioned between the upper shaft and the lower shaft, and the shaft support is structured and configured to strengthen the shaft ensuring that it does not break if it comes into contact with a user, a user's stick, or a hockey puck/ball.

16. The rotational stick handling training device of claim 15, wherein the central rod is enabled to spin freely within the coupling.

17. A method of improving stick-handling skills, the method comprising:

activating a training device, wherein the training device is comprised of:

a central support system comprised of a mechanics housing, rotation mechanics within the mechanics housing that activate the device, and a central rod that functions as a central axis and is supported by the mechanics housing;

a shaft having a proximal end and a shaft support with the shaft support disposed between the upper shaft and the lower shaft;

at least one horizontal support rod having a proximal end connected to the central rod and a distal end connected to the shaft; and one or more rotating projections structured and configured to connect to, and rotate about, the central rod;

wherein the shaft support is structured and configured to strengthen the shaft ensuring that it does not break if it comes into contact with a user, a user's stick, or a hockey puck/ball;

selecting a direction of spin;

selecting a rotational speed; and using a hockey stick to direct a hockey puck around the rotating projections, wherein a user can avoid the rotating projections by directing the hockey puck between the rotating projections and the central support system.

* * * * *